US006276268B1

(12) United States Patent
Takahashi et al.

(10) Patent No.: US 6,276,268 B1
(45) Date of Patent: Aug. 21, 2001

(54) DRUM TYPE PRINTER HAVING MECHANISM FOR ADJUSTING TRANSVERSE POSITION OF PRINTED IMAGE

(75) Inventors: Yasuhiro Takahashi; Katsuro Motoe; Hitoshi Watanabe, all of Inashiki-gun (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/499,438

(22) Filed: Feb. 7, 2000

(30) Foreign Application Priority Data

Mar. 18, 1999 (JP) ..... 11-073385

(51) Int. Cl.[7] ..... B41F 15/38
(52) U.S. Cl. ..... 101/116; 101/119; 101/117
(58) Field of Search ..... 101/114, 116, 101/117, 118, 119, 120, 124, 248, 481, 485, 486, DIG. 36

(56) References Cited

U.S. PATENT DOCUMENTS

| | | | | |
|---|---|---|---|---|
| 4,911,069 | | 3/1990 | Hayama et al. | 101/120 |
| 5,243,904 | | 9/1993 | Hayama et al. | 101/120 |
| 5,507,225 | | 4/1996 | Noguchi et al. | 101/116 |
| 6,076,460 | * | 6/2000 | Kagawa | 101/128.4 |
| B1 6,192,793 | * | 2/2001 | Motoe et al. | 101/116 |

FOREIGN PATENT DOCUMENTS

| | | |
|---|---|---|
| 62-28757 | 6/1987 | (JP) . |
| 1-204781 | 8/1989 | (JP) . |
| 2-225078 | 9/1990 | (JP) . |
| 4-361043 | 12/1992 | (JP) . |
| 5-330224 | 12/1993 | (JP) . |
| 6-71998 | 3/1994 | (JP) . |
| 6-293175 | 10/1994 | (JP) . |
| 7-137234 | 5/1995 | (JP) . |
| 7-137418 | 5/1995 | (JP) . |
| 2-2542489 | 7/1996 | (JP) . |
| 9-1913 | 1/1997 | (JP) . |
| 9-104159 | 4/1997 | (JP) . |

* cited by examiner

*Primary Examiner*—Daniel J. Colilla
(74) *Attorney, Agent, or Firm*—Oliff & Berridge, PLC

(57) ABSTRACT

In order to provide a drum type printer having a mechanism for adjusting a transverse position of a printed image improved such that when a plurality of drawout type drum units are used in the drum type printer, the transverse position of the printed image once adjusted with respect to each drum unit is preserved in each drum unit, wherein the adjustment of the position of the frame means 86 supporting the printing drum 10 relative to the machine frame 24 along the central axis of the printing drum is adjusted by an axial shifting of the shaft member 116 relative to the frame means 86, a shaft member 116 being latched at its one end to the machine frame 24.

5 Claims, 2 Drawing Sheets

DRUM TYPE PRINTER HAVING MECHANISM FOR ADJUSTING TRANSVERSE POSITION OF PRINTED IMAGE

BACKGROUND OF THE INVENTION

1. Field of the invention

The present invention relates to a drum type printer, and more particularly, to a drum type printer having a mechanism for adjusting a transverse position of a printed image.

2. Description of the Prior Art

In Japanese Patent Publication No. 2542489 issued Oct. 9, 1996, there is described a device for adjusting a transverse position of a printed image for a stencil printer having a drum unit rotatably supporting a cylindrical printing drum and slidably mounted in a body of the printer along the longitudinal axis of the printing drum, so as to be manually dismountable out of the printer body at the end of the sliding drawout movement, wherein the printed image transverse position adjustment device comprises guide means provided in the printer body for guiding the drum unit in the sliding direction, a movement transmission system for moving the drum unit in the sliding direction along the guide means for a minute distance, a motor for driving the movement transmission system, and clutch means for optionally connecting or disconnecting the movement transmission system to or from the drum unit.

In the printed image transverse position adjustment device of a stencil printer described in the above-mentioned patent publication, there is an inconvenience with regard to a multi-color superposition printing made by a plurality of printing drums that, when a required number of sheets of a multi-color print have been obtained in a manner such that the required number of sheets of a first print are obtained by using a first printing drum with an adjustment of a transverse position of a printed image, and then the required number of sheets of a second print are obtained by using a second printing drum replaced for the first printing drum with an adjustment of a transverse position of the printed image by the second printing drum, or further the required number of sheets of a third print are obtained by using a third printing drum replaced for the second printing drum with an adjustment of a transverse position of the printed image by the third printing drum, and so on, if a further number of sheets of the same multicolor print are required to be produced by using the first, second or third and other printing drums temporarily stored for an additional demand for the prints, the adjustment of the transverse position of the printed image must be repeated from the very beginning with respect to each of the first, second or third and other printing drums.

SUMMARY OF HE INVENTION

In view of the above-mentioned problems, it is a primary object of the present invention to provide a drum type printer improved so as not to require any readjustment of the transverse position of the printed image with respect to any of the printing drums in the monochromatic or multi-color superposition printing employing a plurality of printing drums when a transverse position of the printed image is once adjusted with respect to each of the printing drums, even when any of the printing drums is reused for a reprinting according to a reorder.

In order to accomplish the above-mentioned object, the present invention proposes a drum type printer comprising:

a machine frame, a printing drum, a back press roller for pressing a print sheet to the printing drum;

frame means for supporting the printing drum to be rotatable around a central axis thereof, the machine frame having guide-hold means adapted to removably engage a part of the frame means for guiding and holding the frame means so as to be movable along the central axis of the printing drum, and drawably receiving the frame means and the printing drum supported thereby, printed image transverse position adjustment means including a shift member mounted in the frame means so as to be shiftable along the central axis of the printing drum along a shift path relative to the frame means at least as much as a shift distance corresponding to a maximum value of an adjustment of a transverse position of a printed image, drive means for selectively shifting the shift member relative to the frame means along the shift path, and latch means for selectively latching the shift member at a part thereof to the machine frame when the frame means are at an installed position thereof in the machine frame, such that a shifting of the shift member relative to the frame means along the shift path effected by the drive means with the latch means latching the shift member to the machine frame adjusts the transverse position of the printed image.

By the above-mentioned construction of the drum type printer, the axial position of the printing drum relative to the machine frame for an adjustment of a transverse position of a printed image is determined by the position of an adjustment of the shift member relative to the frame means. Since the shift member is a member mounted in the frame means, even when the drum unit integrally constructed by the printing drum, the frame means and the shift member is returned to its installed position in the machine frame after it has once been removed out of the machine frame from the installed position, the once adjusted position of the shift member relative to the frame means does not change, and therefore, the adjustment of a transverse position of a printed image once made with respect to each drum unit is maintained as unchanged until a next readjustment thereof.

The shift member may be a shaft member having a screw portion and engaged in a tapped bore formed at a part of the frame means by the screw portion, and the drive means may be means for selectively driving the shaft member in rotation around a central axis thereof relative to the frame means.

The drive means may include a splined portion formed at another part the shaft member, a gear wheel engaging the splined portion, and an electric motor for driving the gear wheel in rotation.

The shaft member may be disposed in the frame means along the central axis of the printing drum.

There may be provided means for positioning the shift member at a latch position for latching the shift member to the frame member by the latch means.

BRIEF DESCRIPTION OF THE DRAWINGS

In the accompanying drawings.

DESCRIPTION OF THE PREFERRED EMBODIMENT

In the following, the present invention will be described in detail with respect to an embodiment thereof with reference to the accompanying drawings.

Figure 1:
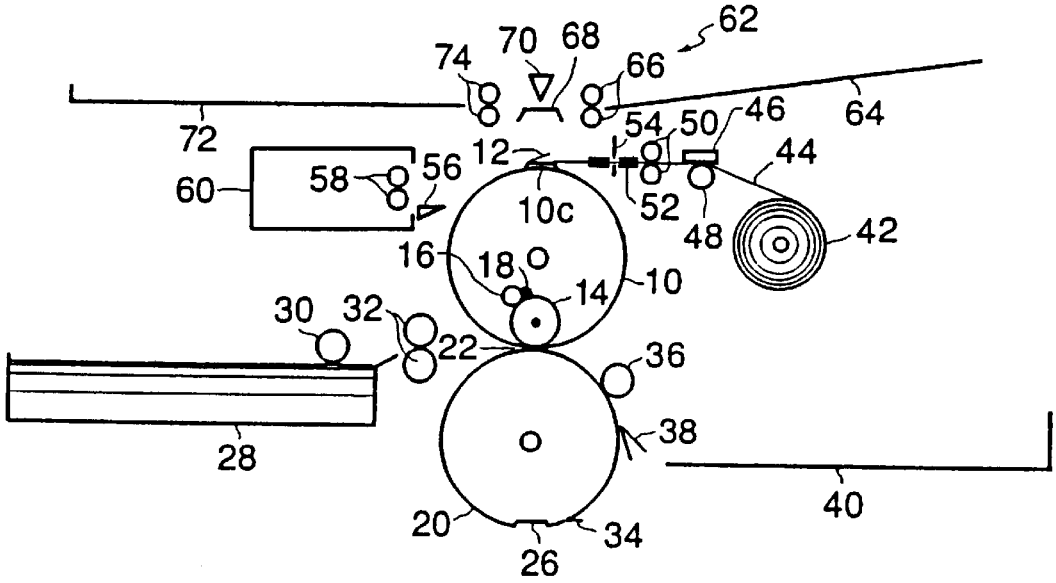
FIG. 1 is a diagrammatical plan view showing an embodiment of the overall construction of the drum type printer having a mechanism for adjusting a transverse position of a printed image.
Figure 2:
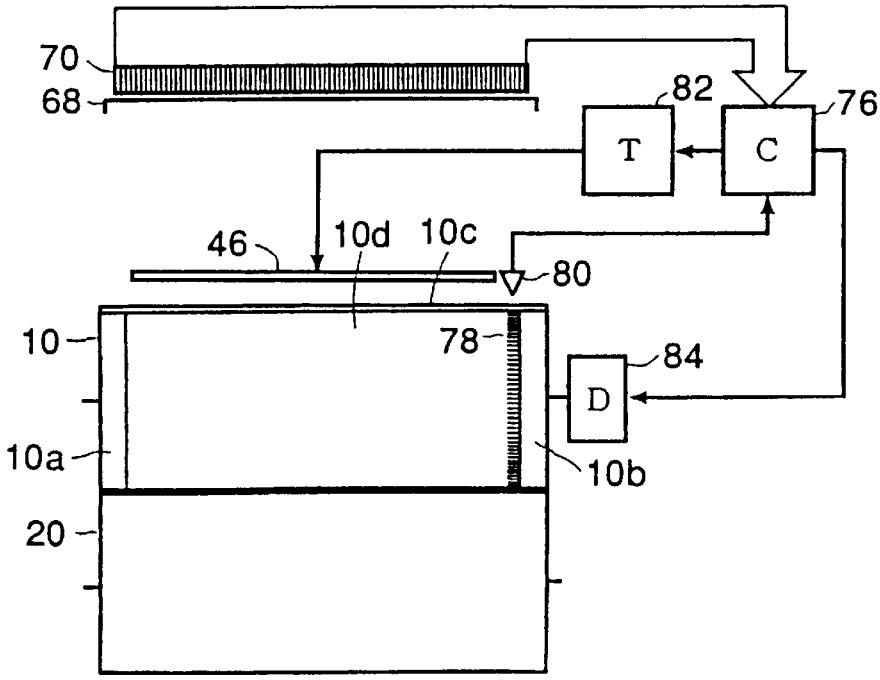
FIG. 2 is a diagrammatical side view of the printer shown in FIG. 1.
Figure 3:
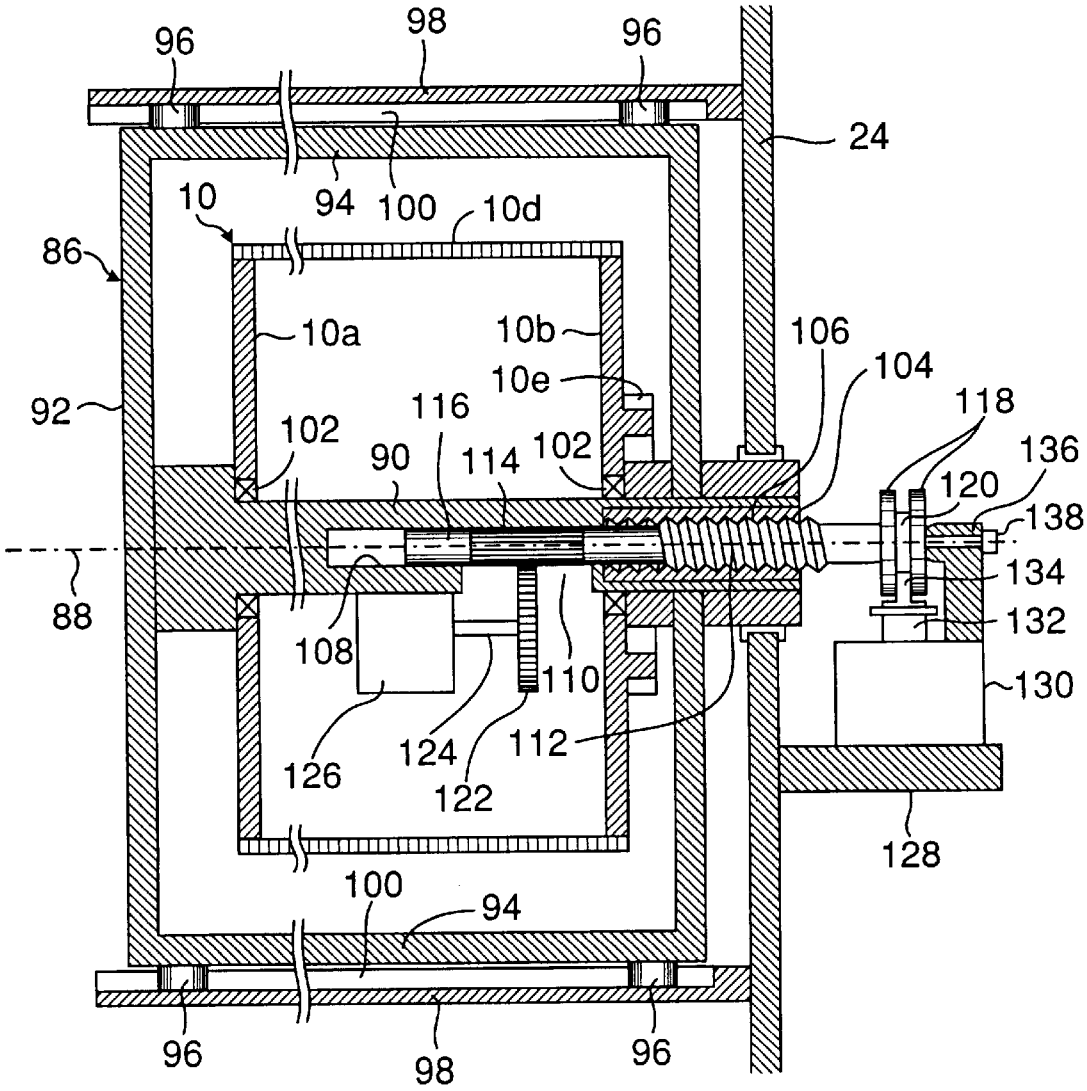
FIG. 3 is a somewhat diagrammatical sectional view of an embodiment of an essential portion related to the present invention corresponding to a part of the printing drum of the printer shown in FIGS. 1 and 2.

Referring to FIG. 1 showing diagrammatically in a front view an overall construction of an embodiment of the drum type printer having a mechanism for adjusting a transverse position of a printed image according to the present invention, and FIG. 2 diagrammatical showing a side view thereof, the mechanism for adjusting a transverse position of a printed image forming the essential part of the present invention is, however, not exhibited in this diagrammatical illustration of the overall construction of the drum type printer in FIGS. 1 and 2, but is exhibited in FIG. 3 showing an embodiment of the present invention somewhat diagrammatically with respect to a part of the drum unit.

First, the overall construction of the drum type printer according to the present invention will be described with reference to FIGS. 1 and 2. In these figures, 10 is a printing drum which has a frame made of a pair of rigid annular members 10*a* and 10*b* forming opposite axial end portions thereof and a bar member 10*c* bridged between and firmly connected with the annular members, and a perforated cylindrical circumferential wall 10*d* forming a principal portion of the printing drum, wherein the circumferential wall 10*d* is made of a net or a perforated plate having a rectangular shape in development and bent into a cylindrical shape. One end of the net or the perforated plate is fixed to the bar member 10*c*, with opposite side edge portions thereof being sidably laid on and along the outer circumferential surface of the annular members 10*a* and 10*b* in a circumferential direction. The details of the construction of such a printing drum are described in Japanese Patent Laid-open Publication 2-225078 of an application filed by the same assignee as the present application. The bar member 10*c* is provided with a clamp 12 for mounting a leading end of a stencil sheet.

Inside the printing drum 10, there is provided an inking roller 14 in contact with an inner circumferential surface of the circumferential wall 10*d* to supply ink thereto. A doctor rod 16 is provided adjacent the inking roller 14. A wedge shaped space formed between the inking roller and the doctor rod is supplied with ink by ink supply means not shown in the figure, so as to form an ink clod 18.

Outside the printing drum, there is provided a back press roller 20 in parallel thereto. The printing drum 10 and the back press roller 20 oppose one another in a band area extending along generatrices of the respective circumferential surfaces at portions thereof opposing one another, thereby defining therebetween a nip region 22 for carrying out a printing such that the ink extruded through perforated portions of the stencil sheet wrapped around the printing drum 10 is attached onto a print sheet pressed between the printing drum and the back press roller.

Although not shown in FIGS. 1 and 2, the printing drum 10 and the back press roller 20 are supported by a machine frame indicated as 24 in FIG. 3, so as to rotate around the respective central axes. When the circumferential wall 10*d* of the printing drum is not pressed radially outwardly from its inside by the inking roller 14, there is left a gap between the circumferential wall of the printing drum and the outer circumferential surface of the back press roller 20 opposing in the nip region 22. At a time of printing when a print sheet is passed through the nip region 22 as described later, the circumferential wall 10*d* having a flexibility as made of the net or the perforated plate is extruded radially outwardly by the inking roller 14 toward the back press roller 20, thereby canceling the gap in the nip region 22, so that the print sheet is pressed between the circumferential wall l0*d* and the back press roller 20. The details of on-off control of the nip region 22 in the above-mentioned manner are described in the above-mentioned Japanese Patent Laid-open Publication 2-225078.

The printing drum 10, the inking roller 14 and the back press roller 20 are driven to rotate in synchronization with one another by a drive system not shown in the figure. In the shown embodiment, the printing drum 10 and back press roller 20 are of the same diameter as each other, and are driven at a common rotation speed in directions opposite to each other. The back press roller 20 is formed with a groove 26 at a portion of its circumferential surface along a generatrix thereof, so as to receive the bar member 10*c* of the printing drum when it passes through the nip region 22.

There are provided print sheet supply means including a print sheet supply tray 28, a print sheet takeout roller 30 and a pair of print sheet transfer rollers 32, so as to supply print sheets one by one to the nip region 22 in synchronization with the rotations of the printing drum 10 and the back press roller 20. In the shown embodiment, the back press roller 20 is provided with print sheet holding means described in Japanese Patent Laid-open Publication 4-361043 of an application filed by the same assignee as the present application. The print sheet holding means include a clamp 34 provided at the outer circumferential surface of the back press roller 20 along a generatrix thereof for clamping a leading end of a print sheet transferred toward the nip region 22 onto the back press roller 20, and a pair of press rollers 36 for pressing opposite side edge portions of the print sheet onto the back press roller 20, so as to hold the print sheet passed through the nip region 22 in a condition held on the back press roller. The leading end of the print sheet is released from the clamp 34 after having passed below the rollers 36, and is peeled off from the back press roller 20 by a peel-off claw 38, so as to be received on a print sheet receiving tray 40.

42 is a roll of stencil sheet. A band-like stencil sheet 44 pulled out from the roll is conducted through stencil sheet write-in means made of a thermal head 46 having an array of fine thermo-elements and a platen roller 48 for pressing the stencil sheet 44 against the array of the thermo-elements, then through a pair of stencil sheet transfer rollers 50, then through a stencil sheet guide 52, and then through a cutter 54, so that its leading end is mounted on the bar member 10*c* of the printing drum 10 by the clamp 12. After a predetermined length of the stencil sheet has been wound around the printing drum according to its rotation, its rear end is cut by the cutter 54.

A used stencil sheet is removed from the printing drum 10, starting at its leading end clamped on the bar member 10*c* by the clamp 12, after release thereof, so as to be guided by a stencil discharge claw 56 and a pair of stencil discharge rollers 58 according to a stencil discharge rotation of the printing drum 10, and to be received in a stencil discharge box 60.

Above the printing drum 10, there are provided original readout means 62 for a duplicate printing of an original. The original readout means 62 include an original place tray 64 for placing an original thereon with its image facing upward, a pair of original transfer rollers 66 for nipping and transferring the original from its leading end, an original readout head 70 such as the CCD elements for optically reading out colored portions of the original moved on an original readout table 68 to generate an electric original readout signal, and a pair of original transfer rollers 74 for transferring the read out original onto an original receiving tray 72.

The original readout head 70 includes a number of point original readout elements arranged to extend over a width of an original in a direction perpendicular to the direction of transfer of the original by the original transfer rollers 66 and 74, so that at each transfer position of the original under the original readout elements a linear colored portion is read out as analyzed into a large number of dot positions extending over the width of the original. In this case, the colored portions of the original are read out as on-off information at each dot position of a two dimensional dot matrix according to an abscissa taken in a first direction perpendicular to the transfer direction of a rectangular original and an ordinate according to a second direction along the transfer direction of the original.

A set of abscissa dot signals at each position according to the ordinate of the original obtained by the original readout head 70 are supplied to stencil perforation control means (C) 76 constructed by a computer. The stencil perforation control means 76 are also supplied with information with regard to the rotational angle position of the printing drum 10 from pitch mark readout means 80 for optically reading out pitch marks 78 provided along a side edge portion of the printing drum 10. However, the recognition of the rotational angle position of the printing drum by the pitch marks and the pitch mark readout means is an embodiment. The circumferential position along the circumferential wall of the printing drum may be detected by a rotational angle position of the printing drum by employing any known position detection means or rotational position detection means.

The stencil perforation control means 76 produce pattern information of the colored portions of the original according to the above-mentioned two dimensional matrix. When the reading out of the original or the production of the pattern information according to the two dimensional matrix ends, or without waiting its end, each time when a set of abscissa numerical data are obtained with respect to each ordinate position, the readout signals are supplied to thermal head control means (T) 82, whereby the thermal head control means control on and off of the respective thermo-elements of the thermal head 46 based upon the signals received. In the meantime, the printing drum 10 is driven in rotation by rotary drive means (D) 84 based upon a control signal supplied from the stencil perforation control means 76.

FIG. 3 shows somewhat diagrammatically an embodiment of the construction for detachably mounting the printing drum 10 to the machine frame 24 with the printed image transverse position adjustment means forming an essential portion of the present invention. In FIG. 3, the portions corresponding to those shown in FIGS. 1 and 2 with respect to the printing drum are designated by the same reference numerals.

The printing drum 10 is supported by frame means generally designated by 86 to be rotatable about its central axis 88. The frame means 86 include a shaft portion 90 for supporting the printing drum 10 to be rotatable about the central axis 88, and a frame portion 92 for detachably mounting the frame means to the machine frame 24, while carrying the printing drum 10. The frame portion 92 has opposite side edge portions 94 bearing four rollers 96 engaging guide grooves 100 of a pair of guide-hold rails 98 provided in the machine frame 24, so that the frame means are movable relative to the machine frame 24 along the central axis 88 of the printing drum. By such an arrangement, a drum unit is constructed by the frame means 86 and the printing drum 10 supported thereby, such a drum unit being movable relative to the machine frame 24 along the central axis 88 of the printing drum between its installed position such as shown in FIG. 3 and a position outside of the machine frame where the rollers 96 are disengaged out of the guide grooves 100 of the guide-hold rails 98 after a movement leftward in the figure. When the drum unit is in the installed position shown in FIG. 3, the printing drum 10 is driven at a gear wheel lOe provided at its annular member 10*b* by a drive gear wheel not shown in the figure. Further, although not shown in the figure, the drive torque supplied to the annular member lob is transmitted to the annular member 10*a* by a combination of annular gear teeth provided along the circumferential portions of the annular members 10*a* and 10*b* and a pair of pinions meshing therewith and connected with each other by a shaft, so that the annular members 10*a* and 10*b* are driven in synchronization with each other to generate a uniform integral rotation of the printing drum 10, with no twisting of the circumferential wall 10*d* made of a net or a perforated plate.

The pair of annular members 10*a* and 10*b* are supported by the shaft portion 90 via a pair of radial-thrust bearings 102 to be rotatable about the central axis 88 under a restriction against movements in opposite axial directions along the central axis 88 relative to the shaft portion 90.

The shaft portion 90 is formed with a bore 104 opening at an axial end thereof, the bore 104 being formed as a tapped bore 106 in its portion adjacent its open end. Although in the shown embodiment the tapped bore 106 is provided by a sleeve member inserted into the body of the shaft portion, such a detail of construction is a matter of design for the convenience of forming the tapped bore.

A portion of the bore 104 extending inside of the tapped bore 106 is formed as a cylindrical bore 108 having a diameter not larger than the inner diameter of the tapped bore 106. Further, a part of the inside bore portion 108 is exposed to the outside of the shaft portion 90 by a cutout 110.

A shaft member 116 having a screw portion 112 and a splined portion 116 is mounted in the bore 104 with the screw portion 112 engaging the tapped bore 106. The shaft member 116 has a pair of spaced flange portions 118 at its outside end adjacent the screw portion 112. An annular groove 120 is formed between the pair of spaced flange portions 118. The splined portion 114 of the shaft member 116 exposed through the cutout 110 is engaged with a gear wheel 122 supported by a shaft 124 which is adapted to be selectively driven in rotation by a drive block 126 including a step motor and reduction gears.

A pin 134 provided at a tip end of an armature 132 of a solenoid actuator 130 engages selectively into the annular groove 120 formed between the pair of flange portions 118 of the shaft member 116, the armature being vertically movable in the figure relative to the body of the actuator stationary mounted to the machine frame 24 by a stay 128. An axial movement of the shaft member 116 relative to the machine frame 24 rightward in FIG. 3 is restricted by an axially outside end face of the flange portion 118 abutting a stopper 136 at such a position that the pin 134 of the armature 132 aligns with the annular groove 120. The stopper 136 is, in the shown embodiment, stationary mounted to the machine frame 24 by the housing of the actuator 130 and the stay 128. The stopper 136 is provided with a sensor 138 for detecting the abutment of the end face of the shaft member 116 at the stopper.

In the above-mentioned construction, supposing that the drum unit of the frame means 8G and the printing drum 10 supported thereby is mounted in the machine frame 24 at the installed position as shown in FIG. 3, with the annular groove 120 of the shaft member 116 being engaged by the pin 134 at the tip end of the armature 132 of the actuator 130, when the drive block 126 is operated for a desired printed image transverse position adjustment by a printed image transverse position adjustment panel, not shown in the figure, such as, for example, the device disclosed in Japanese Patent Laid-open Publication 7-137234, so that the shaft member 116 is driven in rotation around the central axis thereof by the gear wheel 122 engaging the splined portion 116 of the shaft member, there is generated a relative displacement between the shaft member 116 and the shaft portion 90 of the frame means along the central axis 88 of the printing drum. Since any axial movement of the shaft member 116 relative to the machine frame 24 is prohibited by the flange portions 118 thereof being engaged by the armature 132 of the actuator, the frame means 86 are shifted together with the printing drum 10 in the leftward or rightward direction in FIG. 3 as guided by the pair of guide-hold rails 98, so as to generate a displacement relative to the back press roller 20 along the central axis of the printing drum. Therefore, the transverse position of the printing drum 10 relative to a print sheet passed through the nip region 22 as carried on the circumferential surface of the back press roller 20 is correspondingly changed, thereby effecting an adjustment of the transverse position of the printed image on the print sheet.

When the drum unit including the assembly of the printing drum 10 and the frame means 86 is to be taken out from the installed position in the machine frame 24 shown in FIG. 3, the actuator 130 is operated so as to remove the pin 134 at the tip of armature 132 out of the annular groove 120 of the shaft member 116. In such a condition, the drum unit may be drawn out of the machine frame, while maintaining the required adjustment of the printed image transverse position. Thereafter, another drum unit of the same type may be mounted into the machine frame along the pair of guide-hold rails 98 to the installed position shown in FIG. 3 until the end face of the flange portion 118 of the shaft member abuts against the stopper 136. Such an abutment will be detected by the sensor 138, so that the actuator 130 is operated so as to engage the pin 134 of the armature 132 into the annular groove 120 Thereafter, an adjustment of the printed image transverse position may be made as desired with respect to the second drum unit. When the second drum unit is removed out of the machine frame after its adjustment of the printed image transverse position, the adjustment is preserved with the drum unit.

Thus, when a plurality of drum units had been adjusted for the transverse position of the printed image, even when each drum unit was removed out of the machine frame and is recharged into the machine frame, regardless whether other drum units were charged in the machine frame in the meantime and adjusted for the transverse position of the printed image, the former adjustment of the transverse position of the printed image is immediately available as preserved therein, with no need of each time adjustment.

Although the present invention has been described in detail with respect to an embodiment thereof in the above, it will be apparent for those skilled in the art that various modifications are possible with respect to the shown embodiment within the scope of the present invention.

What is claimed is:

1. A drum type printer comprising:

a machine frame, a printing drum, a back press roller for pressing a print sheet to the printing drum;

frame means for supporting the printing drum to be rotatable around a central axis thereof, the machine frame having guide-hold means adapted to removably engage a part of the frame means for guiding and holding the frame means so as to be movable along the central axis of the printing drum, and drawably receiving the frame means and the printing drum supported thereby, printed image transverse position adjustment means including a shift member mounted in the frame means so as to be shiftable along the central axis of the printing drum along a shift path relative to the frame means at least as much as a shift distance corresponding to a maximum value of an adjustment of a transverse position of a printed image, drive means for selectively shifting the shift member relative to the frame means along the shift path, and latch means for selectively latching the shift member at a part thereof to the machine frame when the frame means are at an installed position thereof in the machine frame, such that a shifting of the shift member relative to the frame means along the shift path effected by the drive means with the latch means latching the shift member to the machine frame adjusts the transverse position of the printed image.

2. A drum type printer according to claim 1, wherein the shift member is a shaft member having a screw portion and engaged in a tapped bore formed at a part of the frame means by the screw portion, and the drive means are means for selectively driving the shaft member in rotation around a central axis thereof relative to the frame means.

3. A drum type printer according to claim 2, wherein the drive means include a splined portion formed at another part of the shaft member, a gear wheel engaging the splined portion, and an electric motor for driving the gear wheel in rotation.

4. A drum type printer according to claim 2, wherein the shaft member is disposed in the frame means along the central axis of the printing drum.

5. A drum type printer according to claim 1, further comprising means for positioning the shift member at a latch position for latching the shift member to the frame member by the latch means.

* * * * *